United States Patent [19]

Sherburne

[11] Patent Number: 4,875,671

[45] Date of Patent: Oct. 24, 1989

[54] TRANSPORTING AND SORTING SYSTEM FOR A FLEXIBLE WORKPIECE

[75] Inventor: David G. Sherburne, Ontario, N.Y.

[73] Assignee: Eastman Kodak Company, Rochester, N.Y.

[21] Appl. No.: 197,006

[22] Filed: May 20, 1988

[51] Int. Cl.[4] ..... B65H 29/60; B65H 39/11

[52] U.S. Cl. ..... 271/302; 271/184; 271/300; 271/303; 271/305; 271/272; 198/369

[58] Field of Search ..... 271/184, 185, 186, 200, 271/225, 272, 273, 274, 275, 287, 297, 300, 298, 302, 303, 305, 288; 270/58; 198/624, 369

[56] References Cited

U.S. PATENT DOCUMENTS

| | | | |
|---|---|---|---|
| 1,494,378 | 5/1924 | Schmidt . | |
| 2,719,714 | 10/1955 | Pratt et al. | 271/ |
| 3,371,926 | 3/1968 | Anderson et al. | 271/297 |
| 3,430,951 | 3/1969 | Hulka et al. | 271/302 |
| 3,998,453 | 12/1976 | Dorer | 271/272 |
| 4,111,410 | 10/1978 | Tates et al. | 271/ |
| 4,245,835 | 1/1981 | Turner | 271/ |
| 4,277,061 | 7/1981 | Nagel et al. | 271/303 X |
| 4,315,621 | 2/1982 | Snellman | 271/302 X |

FOREIGN PATENT DOCUMENTS

| | | | |
|---|---|---|---|
| 1113358 | 8/1961 | Fed. Rep. of Germany | 271/184 |
| 0048151 | 4/1980 | Japan | 271/297 |

*Primary Examiner*—Joseph J. Rolla
*Assistant Examiner*—Edward S. Ammeen
*Attorney, Agent, or Firm*—Robert H. Sproule

[57] ABSTRACT

A system for distributing flexible sheet material by class into separate containers includes a large endless belt and a number of individual distribution roller assemblies each of which includes a smaller endless belt which opposes the larger endless belt at successive locations. The sheet material is transported vertically between the larger endless belt and the smaller endless belts of the individual roller assemblies. Distribution of the sheet material into one of the containers results when the roller assembly associated with that container is repositioned mechanically so that the smaller endless belt and the opposing portion of the larger endless belt are positioned horizontally at the entrance to the container.

5 Claims, 6 Drawing Sheets

TRANSPORTING AND SORTING SYSTEM FOR A FLEXIBLE WORKPIECE

TECHNICAL FIELD

The present invention pertains to a system for transporting various classes of flexible sheet material, such as a reuseable phosphor screen, and for sorting this sheet material by class.

BACKGROUND OF THE INVENTION

A major problem associated with the transporting and sorting of flexible sheet material is damage to the sheet material caused by the transporting medium. For example, in U.S. Pat. No. 4,111,410 by Tates et al there is disclosed a sorting apparatus for collating the output of a copying machine in which the copy sheets are redirected from transport rollers to storage bins by individual deflection gates. Likewise, in U.S. Pat. No. 3,371,926 by Anderson there is disclosed a document sorting and distributing apparatus in which the documents are directed into respective storage locations by movable gate members. A disadvantage with these distribution devices is the wear created on the sheet material when a mechanical gate is utilized to redirect the sheet material into a storage location. This wear becomes particularly pronounced when the sheet material is reusable and thus subjected to repeated recycling through the distribution and sorting system.

Other distribution systems utilizing endless belts have been disclosed in U.S. Pat. No. 1,494,378 by Schmidt; as well as U.S. Pat. No. 2,719,714 by Pratt and U.S. Pat. No. 4,245,835 by Turner.

Distribution and sorting systems which redirect sheet material into storage locations by mechanical displacement of the belts which transport the sheet material are disclosed in U.S. Pat. No. 4,111,410 by Tates et al, and U.S. Pat. No. 3,998,453 by Dorer. These systems have a common feature in that an external roller is utilized to displace the transporting belt.

SUMMARY OF THE INVENTION

The present invention pertains to apparatus for transporting and distributing a flexible workpiece, such as sheet material, into a container. The apparatus includes flexible first belt means, as well as means for supporting the first belt means in a manner that the first belt means has a main axis which is generally aligned in a first direction. Also provided are first distribution means which include second belt means for engaging the workpiece in a manner that the workpiece is supported between the first belt means and the second belt means for transportation of the workpiece. The first distribution means also includes means for engaging a portion of the first belt means.

In addition, the present invention includes means for moving the first distribution means from a first position, where a main axis of the second belt means is generally aligned in the first direction, to a second position where the main axis of the second belt means is generally aligned in a second direction which leads to the container. The moving means causes the engaging means to displace the engaged portion of the first belt means toward the container in a manner that a portion of the first belt means is generally aligned in the second direction so that the workpiece is transported between the displaced portion of the first belt means and the second belt means to the container.

BRIEF DESCRIPTION OF THE DRAWINGS

These and other features of the present invention will become more readily apparent upon reading the following detailed description in conjunction with the attached drawings, in which.

DETAILED DESCRIPTION OF THE INVENTION

Figure 1:
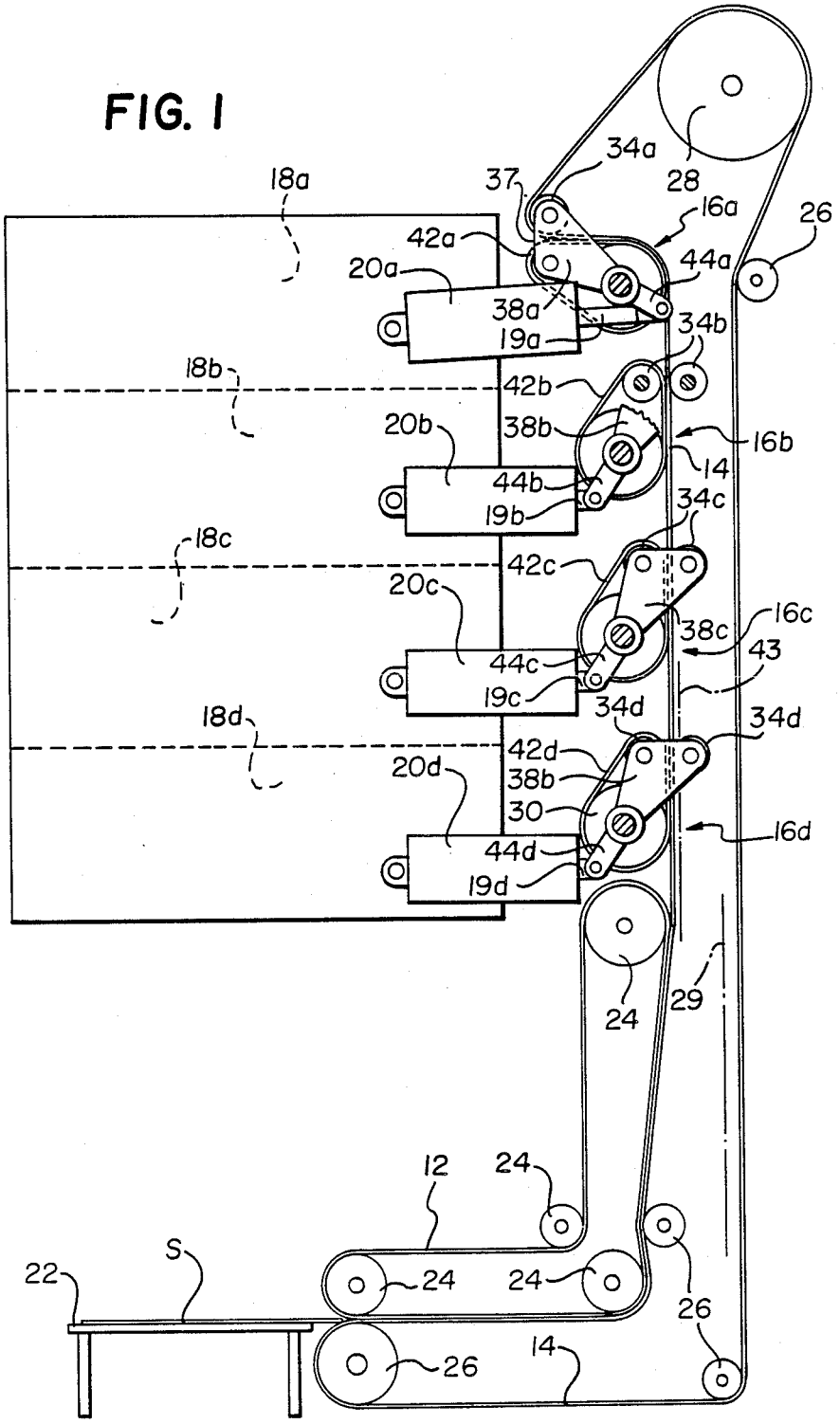
FIG. 1 is side view of the transportation and distribution system of the present invention showing the sheet material in an initial insertion position.
Figure 3:
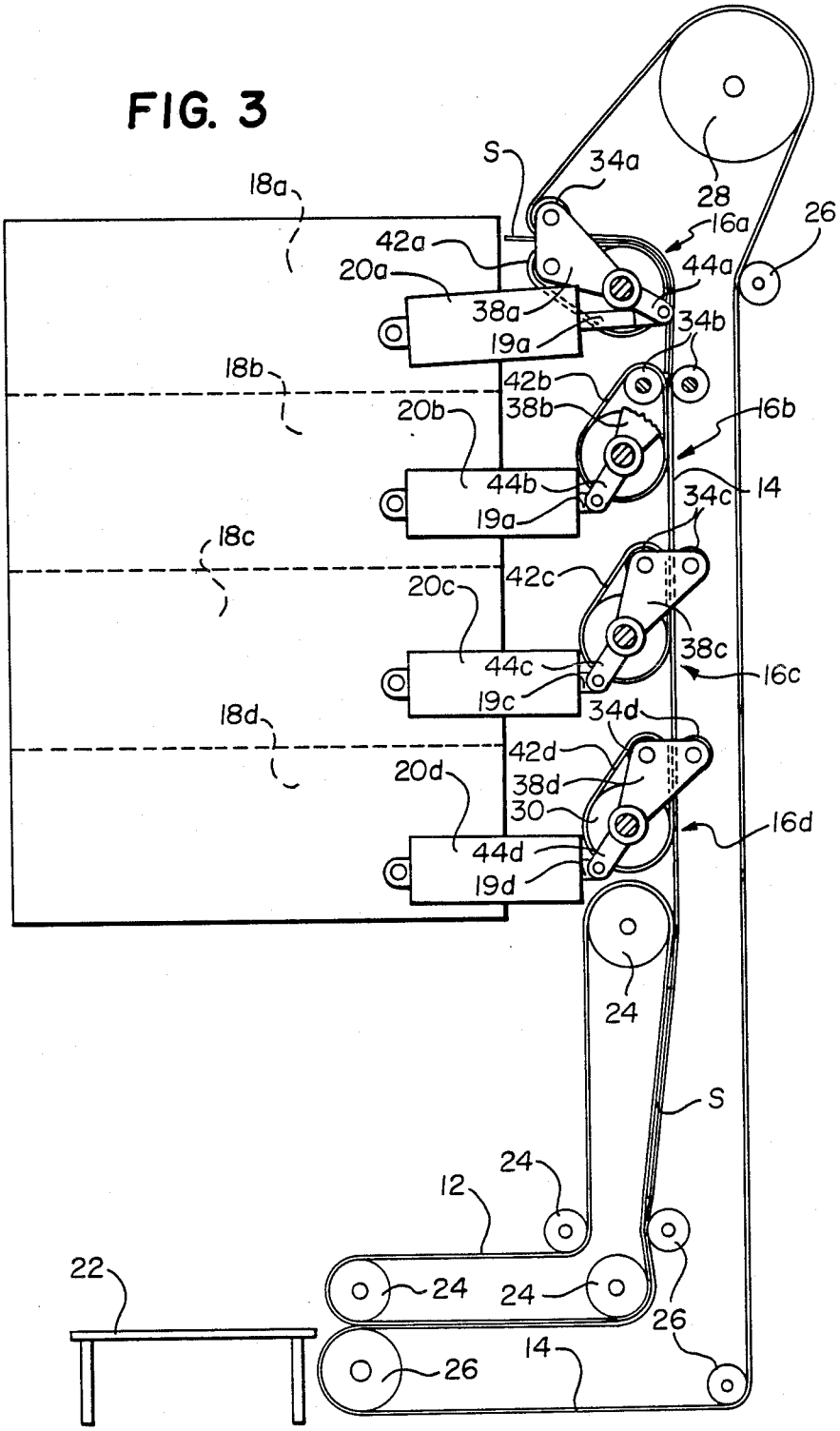
FIG. 3 is a side view similar to FIG. 1 showing movement of the sheet material up the system.
Figure 4:
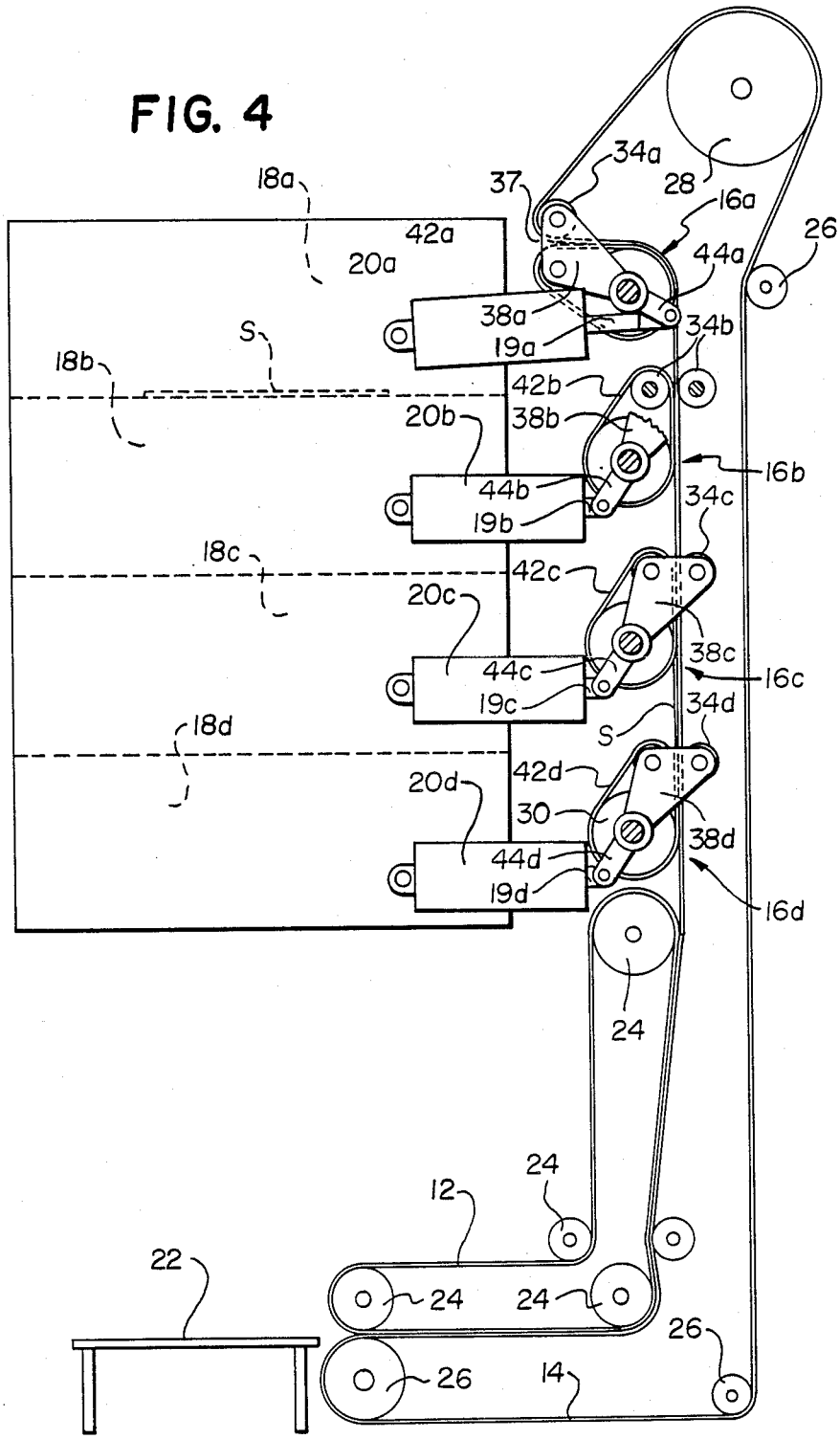
FIG. 4 is a side view similar to FIGS. 1 and 3 showing the distribution of the sheet material into a storage location.

In order to provide a brief overview of the present invention, reference is made to FIG. 1 where there is shown a workpiece, which is an exemplary embodiment is sheet material S, being inserted between two flexible endless belts 12, 14 for movement in a rightward direction, and then in an upward direction as shown in FIG. 3. Upon reaching a number of upper transportation/distribution roller assemblies indicated at 16*a* through *d*, the sheet material is caused to move in a further upward direction until reaching one of the distribution assemblies 16 which is in a horizontal distribution position (assembly 16*a* in FIG. 1.). In this manner, the sheet material is caused to move in a leftward direction where it is discharged into a corresponding upper storage compartment 18 (compartment 18*a* in FIG. 4). In an exemplary embodiment, the sheet material is distributed into various storage compartments 18*a* through 18*d* according to the size of the sheet material.

Figure 5:
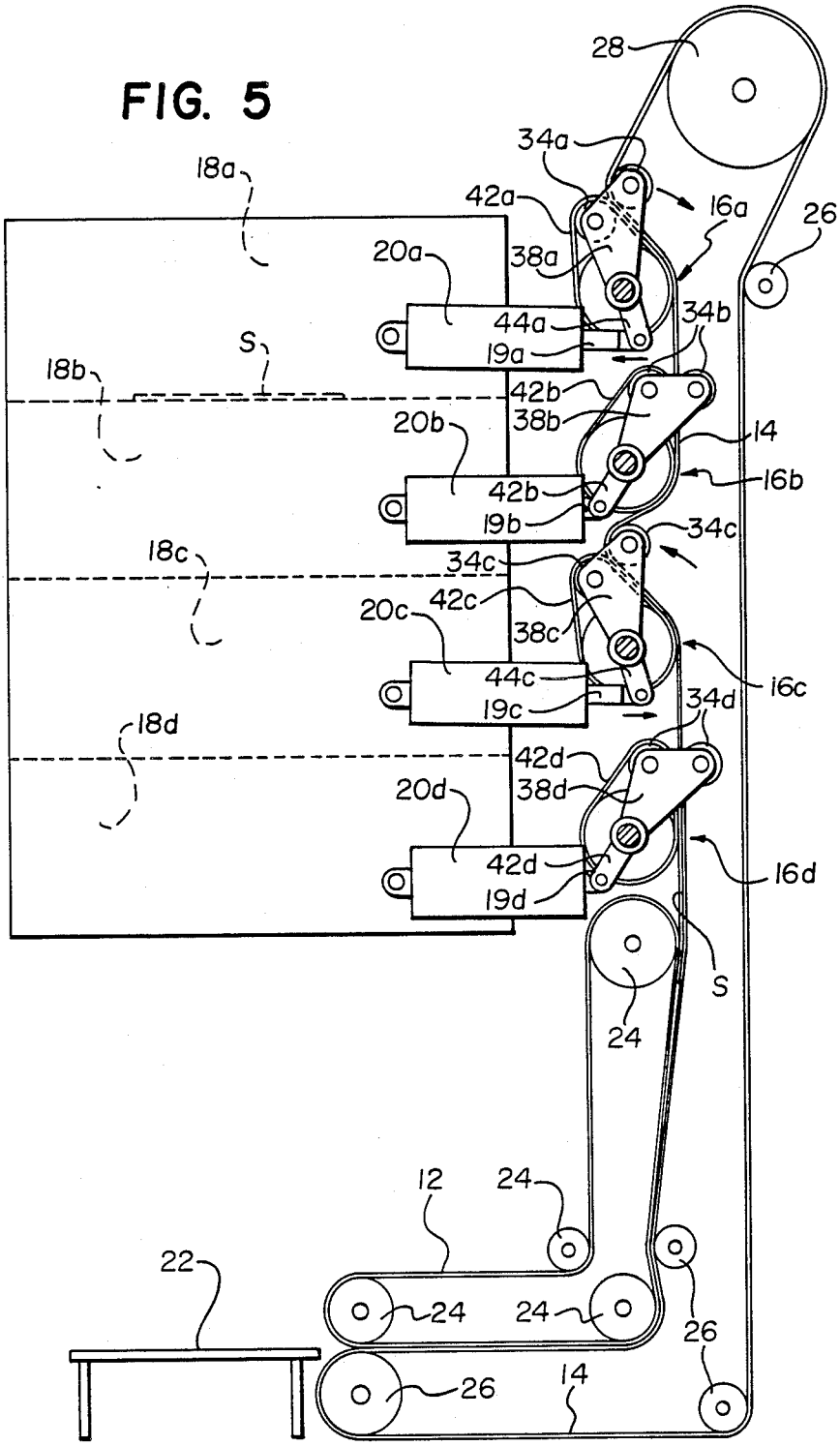
FIG. 5 is a side view similar to FIGS. 1, 3 and 4 showing an intermediate location of a roller assembly between a horizontal distribution position and a vertical transportation position.

Movement of the roller assembly 16 from a vertical transportation position to a horizontal distribution position is accomplished by rightward extension of the associated piston 19 of a conventional cylinder 20; the piston being pneumatically or electrically operated, for example. The resulting rotation of the corresponding roller assembly 16 causes a portion of the belt 14 to be displaced from a vertical to a horizontal position which is adjacent to the entrance of an associated storage compartment 18. This allows for discharge of the sheet material into that storage compartment 18. At the same time, the roller assembly which was in the horizontal distribution position, is rotated in a clockwise direction (FIG. 5) to the vertical transportation position. This permits the leftward displacement of the belt 14 by movement of the distribution roller assembly to the distribution position, and it maintains a constant tension on the entire belt 14.

In an exemplary embodiment, the sheet material S is a reuseable image medium such as phosphor screen, which is discharged from a scanning device (not shown) onto a table 22 in FIG. 1, where it is engaged by the endless belts 12, 14 described previously. In this exemplary embodiment it is desirable to separate the screens by size into the compartments 18. To accomplish this, each screen has a bar code, indicating among other things, the screen's size, which is read by a conventional optical reader (not shown). Based upon the screen size, the appropriate piston 19 is actuated by a conventional microprocessor-based controller (not shown) in order to rotate the corresponding roller assembly and route the screen into the correct storage compartment as discussed previously.

Having introduced the invention briefly, attention now will be turned to its details. As shown in FIG. 1, the sheet material S is supported on the table 22 for introduction between the endless belts 12, 14. The smaller endless belt 12 is engaged by four idler rollers 24 which support the belt 12 in an L-shaped configuration. Furthermore, the larger drive belt 14 is engaged by a number of idler rollers 26 as well as by an upper drive roller 28 and the roller assemblies 16 so as to support the belt 14 in an L-shaped configuration. In this manner, the upper portion of the belt 14 has a generally vertical lengthwise axis identified by the number 29 in FIG. 1. In order to carry the sheet material S between the belts 12, 14, the belt 12 is supported in contact with the belt 14 in a manner that belt 14 drives the belt 12.

Figure 2:
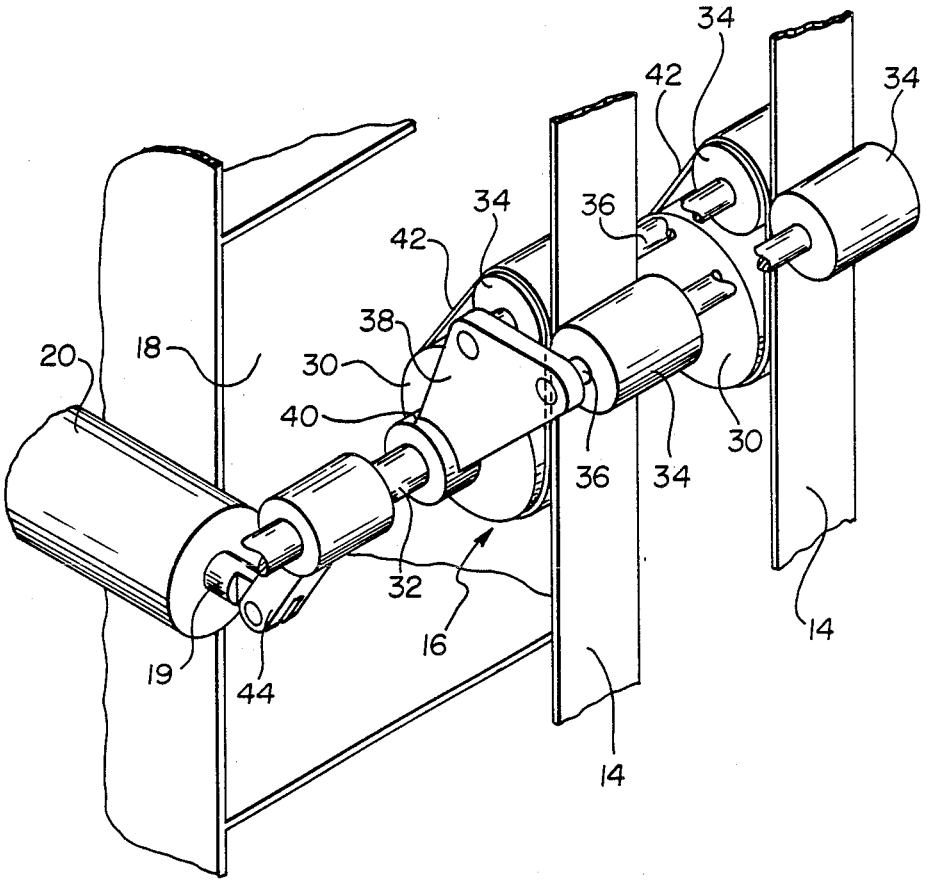
FIG. 2 is partial isometric view of a distribution portion of the system.

In the present embodiment, the transportation/distribution roller assemblies 16 are positioned one above the other directly above the vertical portion of the belt 12. More specifically, and as best shown in FIGS. 1 and 2, each roller assembly 16 includes a pair of axially aligned larger central rollers 30 which are supported for rotation on a main shaft 32. In order to engage a pair of the endless belts 14 therebetween, each roller assembly 16 includes four smaller idler rollers 34 which are mounted axially in pairs on separate shafts 36; shafts 36 being supported in a manner parallel to the main shaft 32. In the present embodiment, shafts 36 are supported at opposite ends by triangular flanges 38 which are connected to respective collars 40, which in turn are affixed to shaft 32. The shaft 32, as well as the idler rollers 24, 26, drive roller 28 and cylinders 20 are supported by an upstanding frame which is not shown. When the distribution assembly 16 is in the vertical transportation position, the right surface of the central roller 30 (FIG. 1) is vertically aligned with a gap 37 between the rollers 34; whereas when the distribution assembly is in the horizontal distribution position, the gap 37 is horizontally aligned with the same surface of the central roller 30.

As indicated by FIG. 1, one roller 34 of each pair is coupled to the corresponding central roller 30 by means of an endless belt 42 having one side which is frictionally engaged with the endless belt 14 along a main vertical axis identified by the number 43 in FIG. 1. In this manner, the belt 42 is rotated by the drive belt 14. When the sheet material is discharged in an upward direction from between the endless belts 12, 14, it is engaged between the endless belts 42, 14 of the lowermost roller assembly 16d. During its upward travel, the sheet material is passed from a lower roller assembly 16 to a higher roller assembly 16 between the belts 42, 14 of each roller assembly.

Rotation of the roller assembly 16 between the vertical transportation position and the horizontal distribution position is accomplished by extending the appropriate piston 19 in a rightward direction. The piston 19 (FIG. 2) is attached to one end of an arm 44 which has its other end affixed to the main shaft 32. The counterclockwise rotation of the roller assembly resulting from extension of piston 19 moves the idler rollers 34 from the vertical transportation position where the rollers 34 are positioned horizontally in a side-by-side manner, and carries them through ninety degree arc in a leftward direction (in FIG. 1) to the entrance of the storage compartment 18 and to the distribution position where rollers 36 are vertically positioned one above the other. This in turn causes a segment of the endless belt 14 between the central roller 30 and the idler rollers 34 to be displaced leftward and downward from a vertical to a horizontal position. This also causes the main axis of the roller assembly belt 42 to be rotated from the vertical position to the horizontal position. In this manner, the sheet material is supported between the roller assembly belt 42 and the drive belt 14 for horizontal movement toward the storage compartment. With nothing downstream to engage the sheet material once it is transported past the idler rollers 34 in the horizontal distribution position, the sheet material falls into the storage compartment.

In order to allow for displacement of the drive belt 14 to the distribution position as well as to maintain a constant tension on the belt 14, during the extension of one of the retracted pistons 19, the piston presently in the extended position is caused to retract so that its associated roller assembly is moved to the vertical transportation position. For example, referring to FIG. 5, piston 19c extends at the same rate that piston 19a retracts. The extension and retraction rates of the pistons 19 are controlled mechanically by the piston/cylinder assemblies. On the other hand, the selection of the pistons for extension and retraction are governed by the controller discussed previously.

Figure 6:
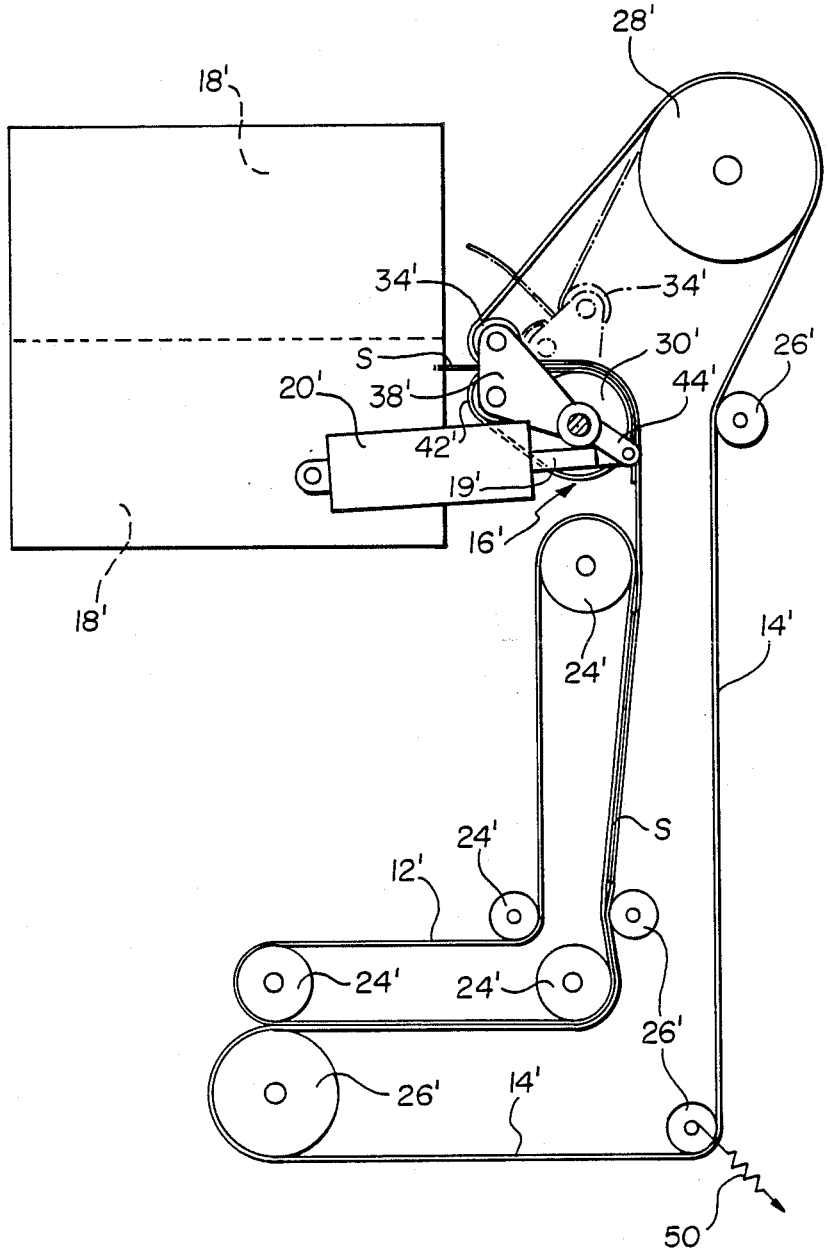
FIG. 6 is a side view of an alternate exemplary embodiment of the transportation and distribution system of the present invention.

In an alternate embodiment of the present invention shown in FIG. 6, like elements described in the previous embodiment are identified by like numerals with a prime (') symbol attached. In this embodiment, only one roller assembly 16' is used to distribute sheet material to a number of storage containers 18'. This is accomplished by halting the counterclockwise rotation of the roller assembly from the vertical transportation position to the distribution position after about forty five degrees of rotation. In this manner, the rollers 34' (shown by hidden lines in FIG. 6) are adjacent to the entrance of the upper container 18' for distribution of the sheet material into this container. Further rotation of the roller assembly (shown by solid lines in FIG. 6) to the aforementioned horizontal position, allows for distribution of sheet material into the lower container 18'. A take-up spring 50 attached to the lower right corner roller 26' maintains proper tension of the belt 14' during rotation of the roller assembly 16'.

In the present invention there are no mechanical gates or the like to divert the sheet material into the storage compartments. Rather, the sheet material is transported and diverted into the storage compartment by the endless belts, thereby reducing the wear to the sheet material.

What is claimed is:

1. Apparatus for distributing a flexible workpiece to a selected holder, the apparatus comprising:

a. flexible first belt means;

b. means for supporting the first belt means in a manner such that the first belt means has a main axis which is aligned generally in a first direction;

c. means for driving said first belt means in said first direction;

d. a plurality of distribution means positioned successively along and adjacent to said first belt means, each distribution means including second belt means for sandwiching a workpiece between the first belt means and the second belt means for transportation of the workpiece, each distribution means further including means for engaging a portion of the first belt means;

e. moving means associated with each of said distribution means for moving the associated distribution means from a first position, where a main axis of the second belt means is aligned generally in the first direction, to a second position where the main axis of the second belt means is aligned generally in a second direction which leads to an associated holder, the moving means simultaneously causing the engaging means of the associated distribution means to displace the engaged portion of the first belt means toward the associated holder such that a portion of the first belt means is aligned generally in the second direction, whereby a workpiece sandwiched between the displaced portion of the first belt means and the second belt means can be transported to the associated holder; and f. means for actuating the moving means associated with a selected distribution means to move said selected distribution means from said first position to said second position in order to transport a workpiece sandwiched between the first belt means and the second belt means of said selected distribution means to a holder associated with said selected distribution means, and for simultaneously actuating moving means associated with another distribution means to synchronously move said other distribution means from the second position to said first position in order to allow displacement of said first belt means by the selected distribution means while maintaining a constant tension on said first belt means.

2. The apparatus as set forth in claim 1, wherein:

each distribution means further includes first and second spaced apart parallel rollers for supporting the second belt means;

the engaging means comprises a third parallel roller which is separated from the second roller by a gap through which the first belt means and the second belt means pass, said third roller being positioned at the same axial location along said first direction as the second roller when the distribution means is in the first position; and the moving means comprises means for jointly rotating said second and third rollers about an axis extending longitudinally through the first roller.

3. The apparatus as set forth in claim 2, wherein: said second direction is substantially orthogonal to said first direction.

4. The apparatus of claim 2, wherein each distribution means is arranged to transport a workpiece into the associated holder without interaction with a mechanical gate or deflector plate.

5. The apparatus of claim 4 wherein said first direction is substantially vertical; the first belt means comprises an L-shaped endless belt; said second belt means comprises an endless belt circumscribing just said first and second rollers; and said workpiece comprises a reusable phosphor screen.

* * * * *